US007086900B2

(12) United States Patent
Comini

(10) Patent No.: US 7,086,900 B2
(45) Date of Patent: Aug. 8, 2006

(54) FIELD-ATTACHABLE CONNECTOR WITH SLIDING CONTACTS

(75) Inventor: Riccardo Comini, Cusano Milanino (IT)

(73) Assignee: Woodhead Industries, Inc., Deerfield, IL (US)

( * ) Notice: Subject to any disclaimer, the term of this patent is extended or adjusted under 35 U.S.C. 154(b) by 63 days.

(21) Appl. No.: 10/749,717

(22) Filed: Dec. 31, 2003

(65) Prior Publication Data

US 2004/0166733 A1 Aug. 26, 2004

(51) Int. Cl.
*H01R 13/40* (2006.01)

(52) U.S. Cl. ..... 439/598; 439/810

(58) Field of Classification Search ..... 439/810–812, 439/733.1, 598, 727

See application file for complete search history.

(56) References Cited

U.S. PATENT DOCUMENTS

| | | | | | |
|---|---|---|---|---|---|
| 4,213,667 | A | * | 7/1980 | Wittes | 439/469 |
| 4,460,235 | A | * | 7/1984 | Gelin | 439/629 |
| 5,664,971 | A | * | 9/1997 | Coy | 439/811 |
| 6,312,296 | B1 | * | 11/2001 | Jones | 439/751 |
| 6,315,615 | B1 | * | 11/2001 | Raistrick | 439/637 |
| 6,764,355 | B1 | * | 7/2004 | Ude et al. | 439/811 |

* cited by examiner

*Primary Examiner*—Hae Moon Hyeon
(74) *Attorney, Agent, or Firm*—Emrich & Dithmar LLC

(57) ABSTRACT

A connector suitable for mounting to a solenoid or the like includes a contact holder adapted to receive and hold a plurality of contact assemblies. Each contact assembly includes a band of closed configuration and having a central opening for receiving the stripped end of a wire, and a contact adapted to couple to an associated contact of the solenoid. A screw is threadedly received in each band and adapted to force the contact into electrical engagement with the wire held within the opening of the band.

9 Claims, 5 Drawing Sheets

FIELD-ATTACHABLE CONNECTOR WITH SLIDING CONTACTS

CROSS REFERENCE TO RELATED APPLICATIONS

This application claims priority benefits based upon co-pending U.S. Provisional Application No. 60/360,977 filed Mar. 1, 2002, and International Application PCT/US03/05853 filed Feb. 26, 2003.

FIELD OF THE INVENTION

The present invention relates to electrical connectors of the type used in manufacturing automation systems. In particular, the invention relates to improvements in a DIN connector adapted to mount, for example, to the body of a solenoid while providing electrical connections for operating the solenoid. Such connectors are currently widely used in manufacturing automation systems. They comply with internationally recognized standards, as persons skilled in the art will readily appreciate.

BACKGROUND AND SUMMARY OF THE INVENTION

Prior art devices adapted for establishing the necessary electrical connections in the field (that is, at the site where the connection to a solenoid or other electro-mechanical actuator is required) employ reliable, but cumbersome techniques for establishing electrical connections. For example, set screws are used in combination with apertured connector blocks. These connectors require that the ends of the wires be stripped, and the stripped ends placed in associated connector blocks. The set screws are then tightened against the wires, forcing the wires into engagement with fixed contact elements adapted to couple electrically with the contact elements of the solenoid or other actuator.

The present invention improves the functionality and reliability of existing connector designs, and facilitates attaching a number of wires of a cable to a connector in the field or replacing an existing connector in the field.

Specifically, the present invention provides, for each contact in the connector, a metallic band of closed configuration which is slidably received in the contact holder of the connector. Each band, which is conductive and preferably made of metal, has a central opening, which may be elongated in the form of a rectangle, for receiving the stripped end of a wire. The wire is placed between the band, which is slidable relative to the contact holder, and a blade contact fixed to the contact holder and adapted to couple to an associated contact element of the solenoid. A threaded screw is received in each band. As the screw is turned, it forces the band into engagement with the stripped end of a wire received in the central aperture of the band, while the free end of the screw holds the contact in place. The wire is forced into engagement with the contact, thus establishing electrical continuity. Thus, the stripped end of each wire is secured within the opening of its associated band, between the band and the contact; and the contact is held between the end of the screw and the wire to which contact is made.

One important advantage of this arrangement is that for a generally uniform torque on the securing screw, there is achieved a reliable and repeatable engagement between the electrical contact of the connector and the incoming wire, which reliability is difficult to achieve when the distal end of the screw engages the wire directly. This advantage is believed to be of particular importance and convenience in the case of assembly in the field.

Other features and advantages of the present invention will be apparent to persons skilled in the art from the following detailed description of the illustrated embodiment, accompanied by the attached drawing wherein identical reference numerals will refer to like parts in the various views.

DETAILED DESCRIPTION OF THE ILLUSTRATED EMBODIMENTS

Figure 1:
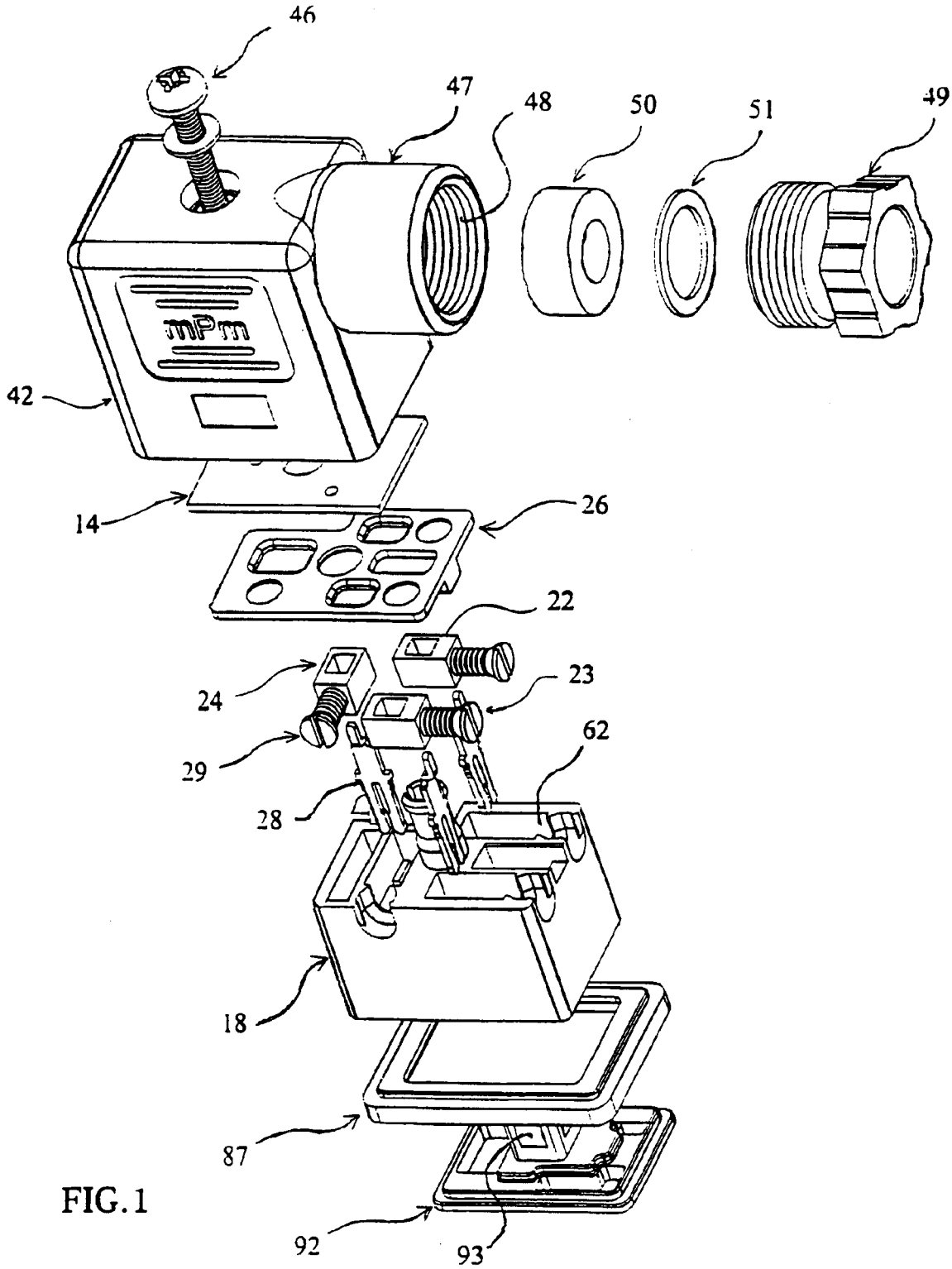
FIG. 1 is a perspective view of a field-attachable connector constructed according to the present invention having three contact assemblies and with the parts in exploded relation.
Figure 1A:
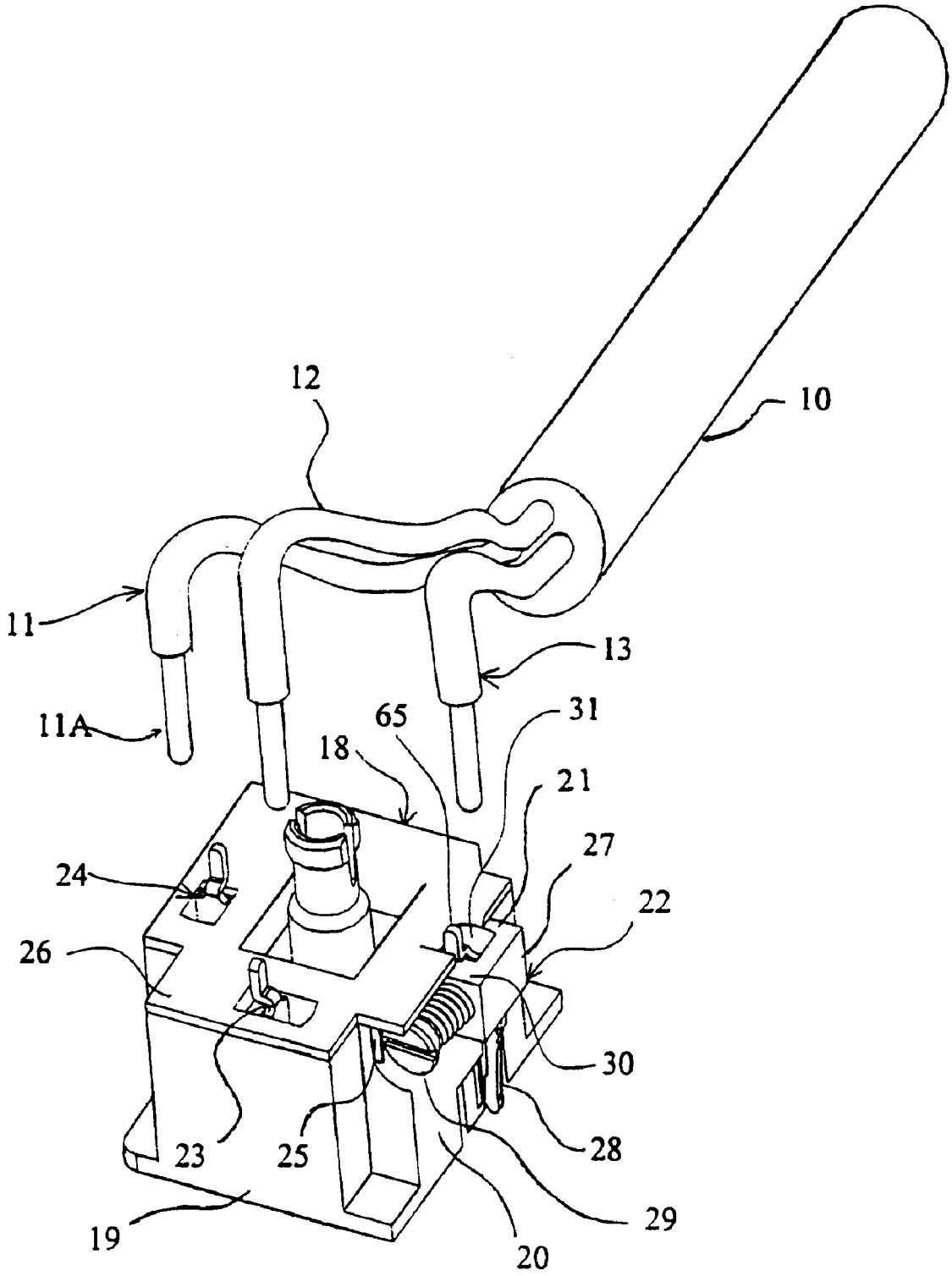
FIG. 1A is an upper perspective view of a contact holder for the field-attachable connector of FIG. 1 illustrating the preparation and assembly of the wires to their associated contact assemblies.

FIGS. 1 and 1A illustrate a field-attachable connector incorporating the present invention having three contact assemblies and FIGS. 2–6 illustrate such a connector having four contact assemblies. Some of the components and some of the structure are common to embodiments of three or four or more contacts, and such common elements may bear the same reference numerals where they are identical or very similar, as persons skilled in the art will appreciate.

Turning first to FIG. 1, an overall explanation of the primary components and elements of the connector will be presented briefly so that the more detailed description which follows will be more readily understood and placed in the overall context of the complete connector.

A conventional casing 42 receives a cable (see 10 in FIG. 1A) through a cable intake 47. The stripped ends of the wires of the cable are assembled to contact assemblies 22, 23 and 24, each of which includes a contact 28. The contact assemblies are received in receptacles (such as that designated 62 for contact assembly 22) formed in the top of a contact holder 18. A contact retainer 26 is placed above the contact holder and secures the contact assemblies in their associated receptacles. An alternate retainer is disclosed in the second embodiment. A printed circuit board 14, if desired, is located above the retainer 26. The incoming wires are placed through suitable apertures in the printed circuit board 14 and contact retainer 26. The upper portions of the contacts 28 may be connected to the printed circuit board, as will be described.

The contact holder, contact assemblies, contact retainer and printed circuit board are then placed in the casing as the cable is withdrawn through the cable intake 47 of the casing. A compression nut 49 is tightened to secure and seal the cable to the casing. A peripheral gasket 87 is assembled to the bottom of the insert and a gasket retainer 92, if used, is assembled to the contact holder 18. The connector is then secured to the solenoid housing by means of the retainer screw 46, as will be understood by those in the art.

Turning now to FIG. 1A, reference numeral 10 generally designates a cable including three insulated wires designated respectively 11, 12, and 13. The distal end of each of the wires 11–13 is stripped of its insulation to expose a section of the conductor, such as that designated 11A for wire 11, as persons skilled in the art will appreciate. The distal end of each of the wires 11–13 is stripped and formed so as to project downwardly toward a contact holder designated 18. In the drawing, contact holder 18 is separated from its associated casing as well as from a solenoid body to which it is intended to be assembled, as will further be disclosed below, but which are known to those skilled in the art.

The contact holder 18 shown in FIG. 1A is suitable for use with three conductors, such as the sheathed wires designated 11–13. Typically, however, connector assemblies of this type, including those incorporating the instant invention may accommodate three or four conductors as well as electronic circuits. A four-conductor embodiment of the instant invention is shown in FIGS. 2–6 and is described further below.

The contact holder 18 may be of a molded, insulating material, formed in the general shape of a cube and having four individual sides, such as the ones designated 19 and 20 in FIG. 1A. The contact assemblies are generally designated 22, 23 and 24 in FIG. 1A. Each of the contact assemblies 22–24 is similar in structure and function in both embodiments, so that only one need be described in further detail for a complete understanding of the invention.

In FIG. 1A, a portion of the wall 20 has been cut away to illustrate more clearly the structure of the contact assembly 22. The contact assembly 22 includes a conductive band 27 of closed configuration (or solid construction) with a central opening 31 for the wire, a fixed metal blade contact (or connecting element) 28, and a threaded screw 29.

Each of these elements will be described in greater detail in connection with the embodiment of FIGS. 2–6, but will first be described in general terms to facilitate an understanding of the functioning of the invention.

The band 27, in the illustrated embodiment, may be made of metal and has a generally rectangular outer dimension in a horizontal plane, thus providing four connected walls arranged in a rectangle and defining the central receptacle or opening 31. The band 27 is slidably received in a receptacle or recess formed in the contact holder 18 (see 62 in FIG. 1) and secured by retainer 26. The upper portion 65 of the fixed metal blade contact 28 is received in the opening 31 of band 27 and extends above retainer 26. The band 27 is permitted to slide along the recess of the contact holder in which the band is received. The screw 29 is threadedly received in a threaded aperture in a heavier adjacent wall 30 of the band 27 so that it projects into the opening 31, engaging the blade contact 28. The contact 28 is staked or otherwise fixed to the contact holder 18. The band 27 may slide within the recess or receptacle 62 in which it is received as the screw 29 is threaded into the band 27. A stop 25 is affixed to the contact holder 18 to limit the motion, of and prevents complete removal of the screw 29.

The stripped distal end of the wire 13 fits into the opening 31 of the contact band 27 between the far wall 21 of the band 27 and the upper portion of the fixed metal blade contact 28, so that when the screw 29 is turned into the band 27, the wall 21 of the band 27 is moved toward and engages the wire, forcing the wire into engagement with the contact 28 and exerting a compressive force on the wire. This forces the contact 28 into electrical connection with the stripped end of the conductor 13 to establish electrical continuity between the wire and the blade contact 28. The other contact assemblies 23, 24 function in the same manner as described for the contact assembly 22, and each of them may have the same structure as described.

Figure 4:
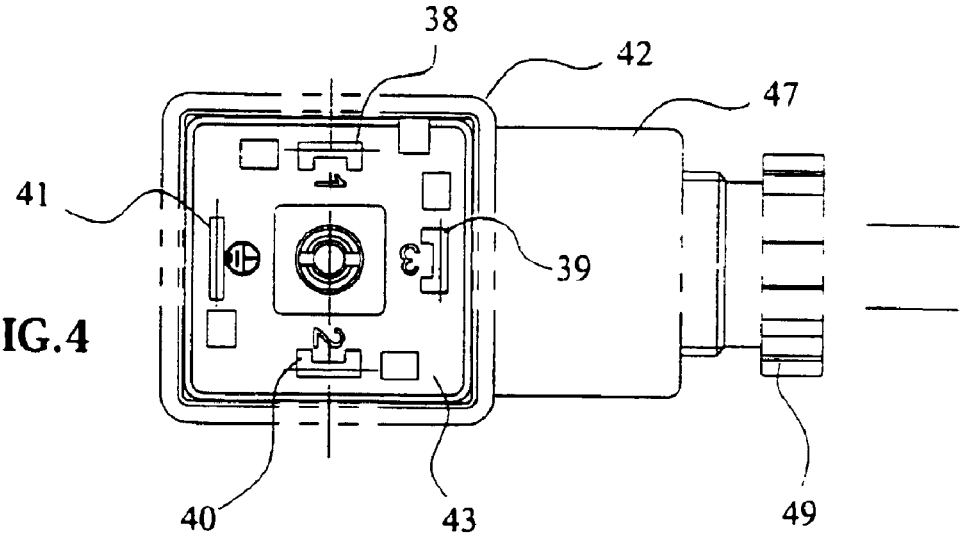
FIG. 4 is a bottom view of the connector of FIG. 2.

Turning now to the embodiment of FIGS. 2–6, there is shown a connector incorporating the present invention having four contact assemblies to accommodate a four-conductor cable (not shown). Thus, the connector of FIGS. 2–6 includes four separate contact assemblies designated respectively 32, 33, 34 and 35 arranged on the sides of a generally square contact holder 43 seen in FIGS. 2–4. The contact assemblies 32–35 may be similar to one another and to the contact assembly described above so that only one need be described for an understanding of the invention. The contact assemblies 32–35 are adapted to accommodate four mating blade contacts typically employed on the solenoid, including three blade contacts having a C-shape in cross section and adapted to be received in corresponding slots 38–40 shown in the bottom of the connector (FIG. 4). Two of the slots 38–40 are used for data leads and the third is a power lead. There is also a straight slot 41 in the bottom of the connector, adapted to receive a straight blade ground connector, as is known in the art.

Figure 3:
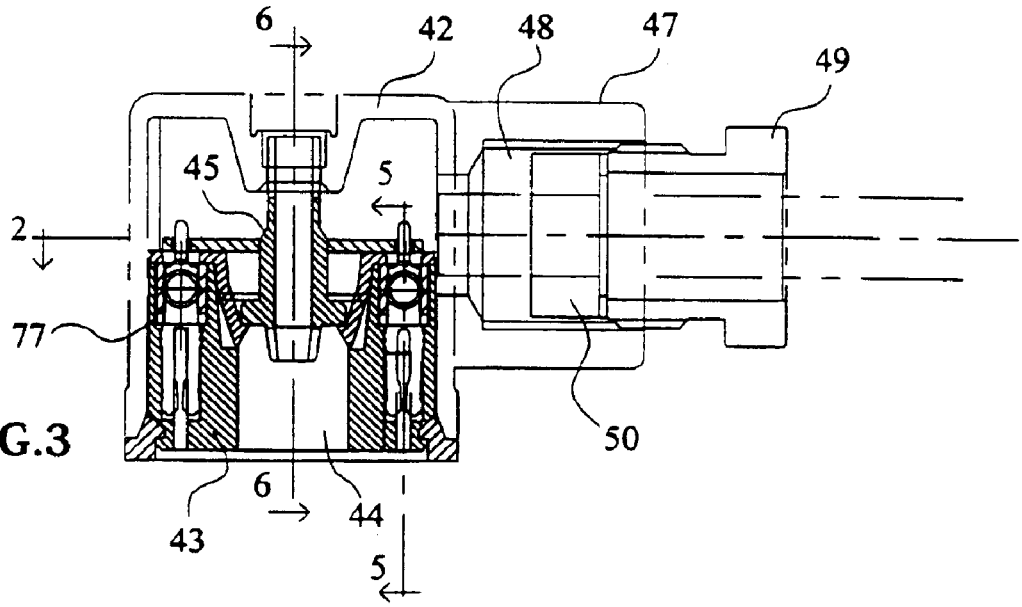
FIG. 3 is a vertical cross-sectional view taken through the sight line 3—3 of FIG. 2.

Referring now to FIG. 3, the contact holder 43 of the four-contact connector defines a lower cavity 44 opening toward the bottom of the connector for receiving gasket retainer 92. An outer casing having a generally square horizontal section and designated 42 in FIG. 3 is received over the contact holder 43. The casing 42 includes four sidewalls and a top wall, the center of which is apertured to receive a tubular guide 45 for receiving a retainer screw 46 which secures the connector to the body of the solenoid, as is conventional. The casing 42 also includes a cylindrical cable intake 47 extending to the side thereof (see FIG. 1) and having an internally threaded opening (designated 48 in FIGS. 1 and 3) for receiving a cable (similar to cable 10 but having four conductors in this embodiment and not shown in FIG. 3 for brevity) to which the connector is to be assembled. A compression nut 49 (see FIG. 1) is placed over the cable and is threadedly received within the cable intake 47 of the casing 42. An annular flexible gasket, or grommet, 50 and washer 51 may be received in the opening 48 for sealing and securing the cable to the connector housing as the compression nut 49 is tightened, again, as is known in the art.

Figure 6:
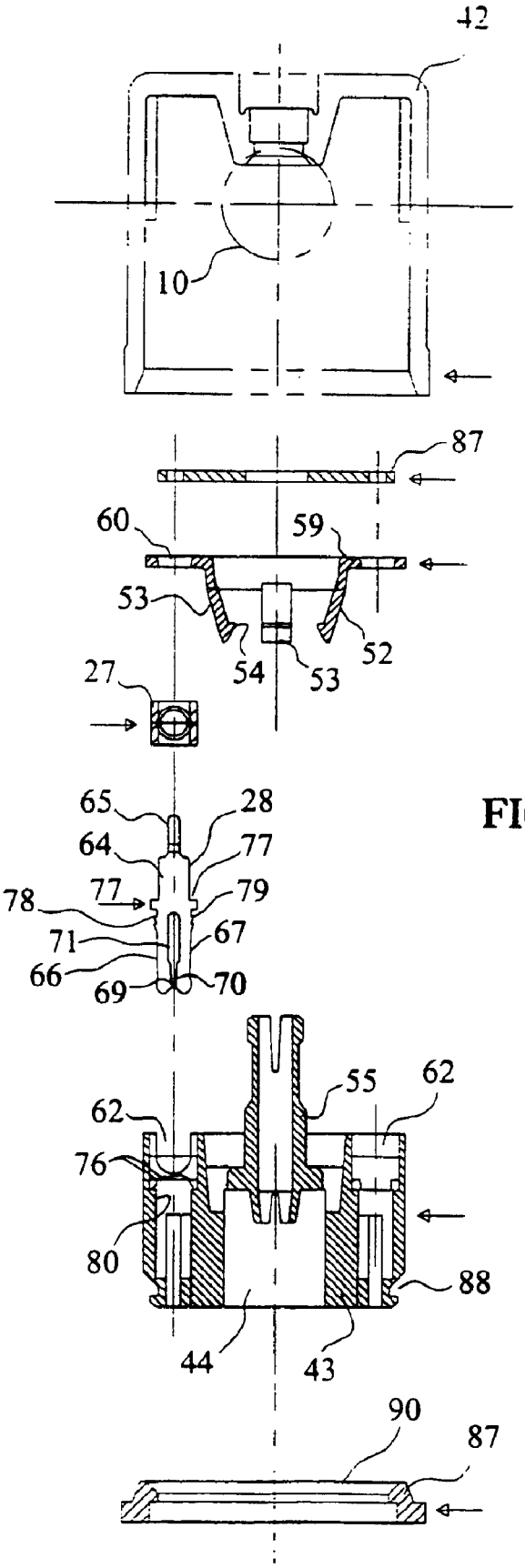
FIG. 6 is a vertical cross-sectional view taken through the sight line 6—6 of FIG. 3 and showing the elements of the connector in exploded relation.

Turning now to FIG. 6, the components of the connector are seen in exploded relation, looking at the connector with the cable 10 extending into the plane of the page. The casing 42 and the contact holder 43 are separate elements. A contact retainer 52 is received on the top of the contact holder 43 and includes four depending latches 53 which extend downwardly from the center of each side section and into the cavity 44 of the contact holder. The depending latches 53 are barbed as seen at 54 to catch beneath the center pedestal 55 of the contact holder for securing the retainer 52 to the contact holder. One of the depending latches 53 can be seen from the front or inside in FIG. 6. The upper portion of the retainer 52 includes a flat peripheral portion 59 which defines apertures such as the one designated 60 for routing wires to each of the connector assemblies in the contact holder 43 and permitting the contacts to extend to the printed circuit board, while holding the contact assemblies in their respective recesses 62. The contact holder 43 defines as many recesses 62 as are required for the number of contact assemblies.

Turning then to the contact assembly and its associated recess 62, each contact assembly includes a blade contact 28 (there are four in the embodiment of FIGS. 2–6) having a flat central engagement portion 64, an upwardly extending tab 65 (which may be offset laterally from the flat central engagement portion 64 as seen in FIG. 1A), and two depending legs 66, 67. The legs 66, 67 include opposing contact areas, or pads, 69, 70 adjacent the lower portion thereof and beneath an enlarged opening, or slot, 71. The contact 69, 70 are spaced to receive a blade of a mating connecting element, the mating blade fitting upwardly into the enlarged slot 71, and the legs 66, 67 providing a contact force on the pads 69, 70 for establishing the desired electrical connection and continuity.

The opening between the pads 69, 70, as well as the enlarged opening 71, are aligned with a slot in the contact holder 43 to receive a contact element of the mating connector corresponding to one of the slot configurations 38–41 of FIG. 4 described above.

The upper portion of the recess 62 is enlarged to define a peripheral shoulder or ledge 76 (FIG. 6). A pair of outwardly extending tabs 77 on the contact 28 rest on the opposite lateral edges of the shoulder 76 when the contact 28 is placed in the recess 62. The contact retainer 52 secures the contact assemblies in place. The upper, enlarged section of the recess 62 is sized to receive the conductive band 27 while permitting the band to move or slide in the direction of the axis of the screw 29. The conductive band 27 is received over, and surrounds the central portion 64 of the contact 28. The conductive band 27 rests on the top of the tabs 77 of the contact 28 to secure the contact in place vertically, while permitting the band to slide laterally, as will be explained. The upper portions of the legs 66, 67 of the contact 28 are barbed as at 78, 79 to fix the contact element in the lower, narrower portion of the recess 62 which is designated 80 in FIG. 6. Thus, the contact is fixed to the contact holder, whereas the conductive band 27 may move in its recess parallel to the axis of the screw 29, and relative to its associated contact 28.

Figure 2:
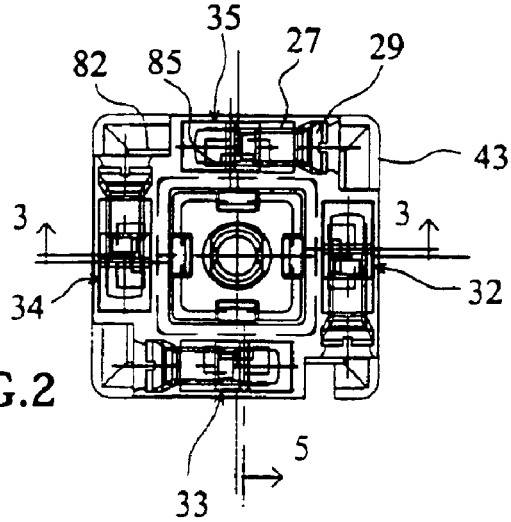
FIG. 2 is a top view of a field-attachable connector having four contact assemblies and incorporating the present invention.
Figure 5:
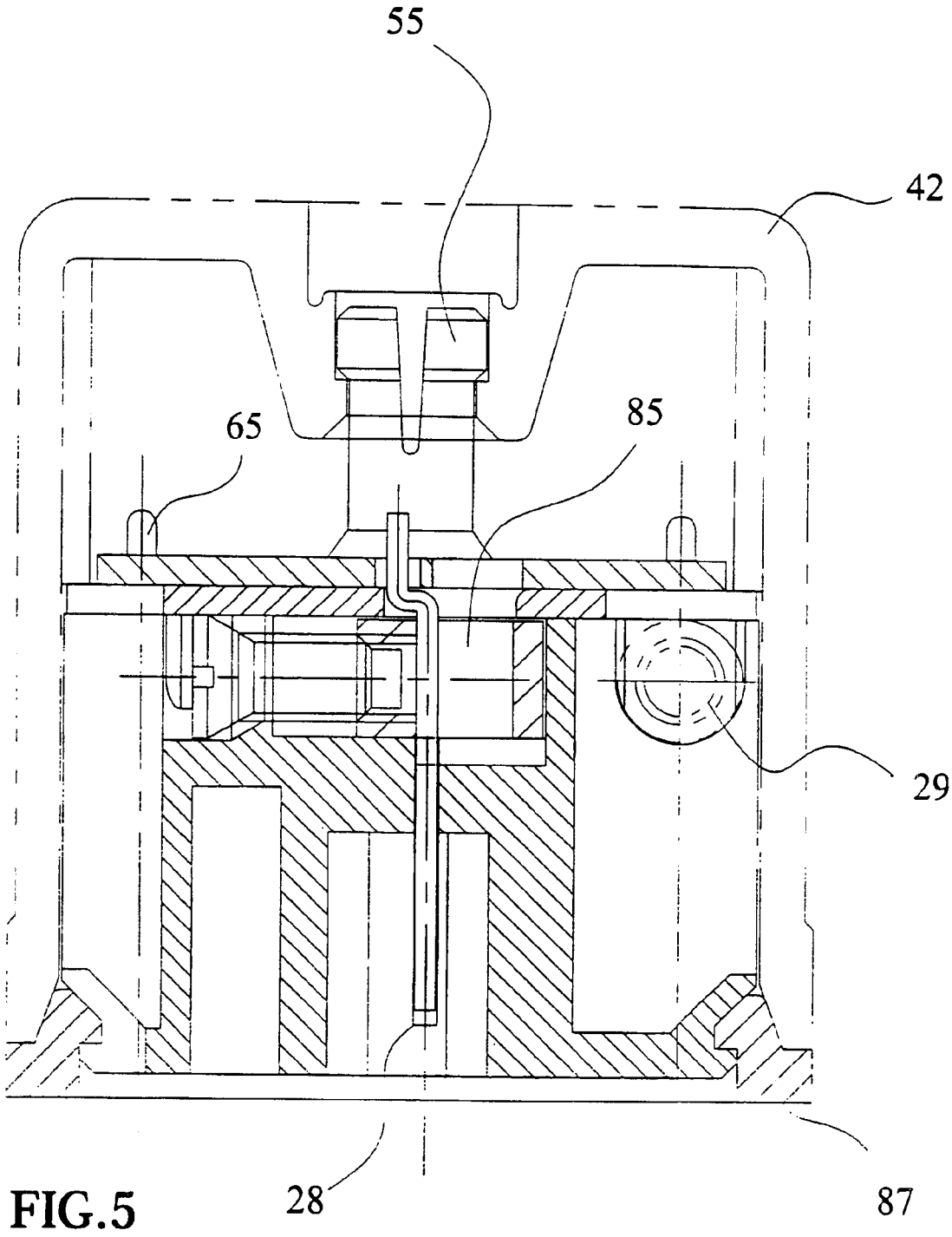
FIG. 5 is a vertical cross-sectional view taken through the sight line 5—5 of FIG. 2.

Turning now to FIG. 2, the conductive band 27, as previously indicated, is generally rectangular in form to be received in the upper, enlarged portion of the recess 62 and to be guided thereby so that it may move laterally relative to the flat central engagement portion 64 of the contact 28. The conductive band 27 is thicker at one end 30, as described above, and has a tapped bore which threadedly receives the screw 29. The distal or driving end of the screw 29 is located adjacent the central, enlarged engagement portion 64 of the contact 28. A stop such as the one designated 82 in FIG. 2 (and similar to the previously described stop 25) is secured in the contact holder for each connector assembly and to limit the motion and prevent removal of the screw 29. The flat central engagement portion 64 forms an engagement surface for the end of the screw 29 when the screw 29 is threaded into the conductive band 27. As best seen in FIG. 2, the interior of the band 27 on the other side of the contact 28 defines an opening 85 for receiving the stripped end of one of the wires as described above (sec FIG. 5). The tab 65 of the contact 28 extends above the flat peripheral portion 59 of the contact retainer 52 and through a conventional printed circuit board (not shown for simplicity) which, if desired, rests on top of the contact retainer and beneath the top surface of the casing 42, as is known in the art.

A peripheral gasket 87 is received on the bottom of the contact holder 43. The bottom of the contact holder 43 includes a peripheral notch 88 which receives an inwardly extending tongue 90 of the peripheral gasket 87. The peripheral gasket 87 is secured to the contact holder 18 by the lower portion of the outer casing 42. The peripheral gasket 87 is adapted to rest on and seal against the casing of the solenoid to which the connector is secured by means of the screw 46 (FIG. 1) which extends through the pedestal 55 and into a corresponding internally threaded opening in the housing of the solenoid as is known in the art. A gasket retainer 92 has an upwardly extending portion 93 which is sized to be snuggly received in the cavity 44 of the insert 43 to hold the gasket 87 in place during installation of the connector, as is known in the art.

To summarize the advantages of the invention, the contact holder 43 may be adapted to two, three or four contact assemblies, as desired. Each contact assembly includes a contact element having a central portion which serves as an engagement area for a threaded screw received in a band surrounding the upper portion of the contact. The band defines an opening for receiving the stripped end of a wire. When the stripped end of the wire is placed in the opening of the band, a screw in the band is tightened to force the wire into engagement with the contact. The wire conductor is thus trapped between the contact and the band of the connector assembly; and a tight, secure and reliable electrical connection is conveniently and rapidly established. This facilitates convenient replacement of the connector in the field without the need of special tools or any particular expertise, and in minimum time.

After all of the desired wires are connected to the contact holder and the associated connector assemblies, the contact holder 43, peripheral gasket 87 and gasket retainer 92 (if used) are assembled into the casing 42, the cable is then pulled outwardly of the cylindrical cable intake portion 47 of the casing 42; and the compression nut 49 is tightened into the connector housing to form a seal by means of the annular flexible gasket 50 which expands between the interior wall of the opening 48 and the outer surface of the feed cable and forms a seal.

Having thus disclosed in detail the illustrated embodiments of the invention, persons skilled in the art will be able to modify certain of the structure which has been disclosed and to substitute equivalent elements for those illustrated, while continuing to practice the principal of the invention; and it is, therefore, intended that all such modifications and substitutions be covered as they are embraced within the spirit and scope of the appended claims.

I claim:

1. An electrical connector adapted to be connected to a cable having a plurality of wires, comprising:

a casing including an intake for receiving said cable;

a contact holder for each of said wires removably received within said casing and including plural receptacles;

a connector assembly seated in each of said receptacles for connecting to an associated one of said wires, each connector assembly including:

a conductive band defining an opening sized to receive an associated wire and first and second opposing portions, said first opposing portion defining an internally threaded aperture, wherein said conductive band is generally rectilinear having four walls defining said opening and wherein said opposing portions thereof are walls;

a threaded member received in said internally threaded aperture of said conductive band; and a contact element adapted to be connected to a mating connector and received in said opening of an associated conductive band adjacent said threaded member, wherein said contact element is a generally flat metal member having first and second depending legs spaced apart to receive in electrical contacting relation a connector element of said mating connector, said contact element further comprising a tab extending upwardly above its associated conductive band;

whereby when a wire is placed in said opening of said conductive band between said second portion of said conductive band and said contact, and said threaded member is tightened, said threaded member forces said contact element against said inserted wire to establish electrical continuity between a wire of said cable and an associated contact element of said connector; and a printed circuit band receiving in electrical contacting relation the tab of said contact element.

2. The connector of claim 1 wherein said first and second spaced legs of said contact element have facing edges, each of said edges being provided with a pad for engaging and establishing electrical continuity with said connector element of a mating connector.

3. The connector of claim 1 wherein said contact element further includes a central portion adapted to be engaged by a distal end of an associated threaded member for applying a compressive holding force to said wire against said second opposing portion of said conductive band.

4. The connector of claim 3 wherein said central portion of said contact element includes a barbed section for engaging opposing walls of a receptacle of said contact holder to secure said contact element in said contact holder.

5. The connector of claim 3 wherein said central portion of a contact element further includes first and second outwardly extending tabs adapted to engage shoulder portions of an associated receptacle of said contact holder when inserted therein for locating said contact element within said contact holder, said connector further including a retainer covering the top of said tabs to prevent displacement of said contact out of said receptacle.

6. An electrical connector adapted to be connected to a cable having a plurality of wires, comprising:

casing including an intake for receiving said cable;

a contact holder for each waid wires removably received within said casing and including plural receptacles;

a connector assembly seated in each of said receptacles for connecting to an associated one of said wires, each connector assembly including:

a conductive band defining an opening sized to receive an associated wire and said first and second opposing portions, said first opposing portion defining an internally threaded apertures;

a threaded member received in said internally threaded aperture of said conductive band; and a contact element adapted to be connected a mating connector and received in said opening of an associated conductive band adjacent said threaded member, wherein said contact element is a generally flat metal member having first and second depending legs spaced apart to receive in electrical contacting relation a connector element of said mating connector, a fastener for securing said casing and said contact holder to a body supporting said mating connector, whereby when a wire is placed in said opening of said conductive band between said second portion of said conductive band and said contact, and said threaded member is tightened, said threaded member forces said contact element against said inserted wire to establish electrical continuity between a wire of said cable and an associated contact element of said connector, and wherein said contact holder includes an upright portion adapted to receive said fastener and defining a pedestal having a base; and a retainer having barbs adapted to extend downwardly into said contact holder and securing to said base of said pedestal for securing said conductive bands in contact holder.

7. An electrical connector adapted to be connected to a cable having a plurality of wires, comprising:

a casing including in intake for receiving said cable; said cable intake including means for sealing said cable to said intake;

a contact holder for each of said wires removably received within said casing and including plural receptacles;

a connector assembly seated in each of said receptacles for connecting to an associated one of said wires, each connector assembly including:

a conductive band defining an opening sized to receive an associated wire and first and second opposing portions, said first opposing portion defining an internally threaded aperture;

a threaded member received in said internally threaded aperture of said conductive band; and a contact element adapted to be connected to a mating connector and received in said opening of an associated conductive band adjacent said threaded member, wherein said contact element is generally flat metal member having first and second depending less spaced apart to receive in electrical contacting relation a connector element of said mating connector; whereby when a wire is placed in said opening of said conductive band between said second portion of said conductive band and said contact, and said threaded memeber is tightened, said threaded member forces said contact element against inserted wire to establish electrical continuity between a wire of said cable and an associated contact element of said connector; and wherein said sealing means includes an externally threaded coupling nut an a grommet adapted to be received over said cable and said coupling nut is threadedly received by said cable intake to force and grommet into sealing relation with said cable.

8. The connector of claim 1 including four individual conductive bands arranged in quadrature about said contact holder and each adapted to receive a respective contact element of a mating connector through a bottom face of contact holder.

9. The connector of claim 8 wherein said contact holder defines a lower central cavity, said connector further including a gasket retainer including a peripheral flange for sealing a bottom portion of said casing to a body securing said mating connector;

said gasket retainer including an extending portion adapted to be received in and releaseably secured within said cavity of said contact holder.

* * * * *

UNITED STATES PATENT AND TRADEMARK OFFICE

CERTIFICATE OF CORRECTION

PATENT NO. : 7,086,900 B2
APPLICATION NO. : 10/749717
DATED : August 8, 2006
INVENTOR(S) : Comini It is certified that error appears in the above-identified patent and that said Letters Patent is hereby corrected as shown below:

| Col. | Line | |
|---|---|---|
| 7 | 21 | delete the word “a” and insert -- said -- |
| 7 | 41 | insert the word -- a -- in the beginning of the sentence |
| 7 | 42 | delete “waid” and insert -- said -- |
| 7 | 48 | delete the word “said” |
| 7 | 50 | delete “apertures” and insert --aperture-- |
| 8 | 32 | after the word “is” insert -- a -- |
| 8 | 33 | delete the word “less” and insert -- legs -- |
| 8 | 40 | after the word “against” and insert -- said -- |
| 8 | 44 | delete the word “an” insert -- and -- |
| 8 | 46 | delete the last word “and” and insert -- said -- |
| 8 | 51 | after the word “of” at the end of the line add the word -- said -- |

Signed and Sealed this

Fifth Day of December, 2006

JON W. DUDAS
*Director of the United States Patent and Trademark Office*